US010113545B2

(12) United States Patent
Schwaiger et al.

(10) Patent No.: US 10,113,545 B2
(45) Date of Patent: Oct. 30, 2018

(54) METHOD OF MANUFACTURING A SCREW PUMP WITHOUT UNDERCUT AND/OR SCREW PUMP WHICH CAN HAVE LUBRICATION CHANNELS ON AT LEAST ONE OF THE DRIVE SCREW AND RUNNING SCREWS

(71) Applicants: Michael Schwaiger, Berlin (DE); Juergen Kreutzkaemper, Waibstadt-Daisbach (DE); Arno Poetzsch, Berlin (DE); Holger Schmidt, Klein-Machnow (DE)

(72) Inventors: Michael Schwaiger, Berlin (DE); Juergen Kreutzkaemper, Waibstadt-Daisbach (DE); Arno Poetzsch, Berlin (DE); Holger Schmidt, Klein-Machnow (DE)

(73) Assignee: SKF Lubrication Systems Germany GmbH, Walldorf (DE)

( * ) Notice: Subject to any disclaimer, the term of this patent is extended or adjusted under 35 U.S.C. 154(b) by 62 days.

(21) Appl. No.: 15/277,140

(22) Filed: Sep. 27, 2016

(65) Prior Publication Data

US 2017/0089336 A1 Mar. 30, 2017

(30) Foreign Application Priority Data

Sep. 29, 2015 (DE) ..... 10 2015 218 679

(51) Int. Cl.
*F03C 2/00* (2006.01)
*F03C 4/00* (2006.01)
(Continued)

(52) U.S. Cl.
CPC ..... *F04C 2/16* (2013.01); *F04C 2/084* (2013.01); *F04C 15/0088* (2013.01);
(Continued)

(58) Field of Classification Search
CPC .... F04C 2/084; F04C 2/16; F04C 2/18; F04C 15/0088; F04C 18/16; F04C 29/02; F04C 2230/00; F04C 2230/26; F04C 2240/20
(Continued)

(56) References Cited

U.S. PATENT DOCUMENTS 2,491,677 A * 12/1949 McCulloch ..... B23P 15/006 29/889.2
3,282,495 A * 11/1966 Walls ..... F04C 18/16 418/201.1
(Continued)

FOREIGN PATENT DOCUMENTS

DE 934605 C 10/1955
DE 1142108 B 1/1963
(Continued)

*Primary Examiner* — Theresa Trieu
(74) *Attorney, Agent, or Firm* — Bryan Peckjian; SKF USA Inc. Patent Dept.

(57) ABSTRACT

A screw pump for transporting a fluid, with a drive spindle having a drive spindle profile and with at least one running spindle having a running spindle profile, the running spindle engages with its running spindle profile at least partially in the drive spindle profile of the drive spindle, the drive spindle profile and/or the running spindle profile is formed as a rolled profile, and a method for producing a spindle for such a screw pump, and a method for producing a groove in such a spindle are disclosed.

11 Claims, 3 Drawing Sheets

(51) Int. Cl.

| | |
|---|---|
| ***F04C 2/00*** | (2006.01) |
| ***F04C 2/16*** | (2006.01) |
| ***F04C 15/00*** | (2006.01) |
| ***F04C 18/16*** | (2006.01) |
| ***F04C 29/02*** | (2006.01) |
| ***F04C 2/08*** | (2006.01) |

(52) U.S. Cl.
CPC ..... *F04C 18/16* (2013.01); *F04C 29/02* (2013.01); *F04C 2230/26* (2013.01); *F04C 2240/20* (2013.01)

(58) Field of Classification Search
USPC ..... 418/1, 195–196, 201.1, 201.3, 418/206.1–206.8
See application file for complete search history.

(56) References Cited

U.S. PATENT DOCUMENTS 4,390,331 A * 6/1983 Nachtrieb ..... F04C 2/084 418/206.5
8,282,371 B2 * 10/2012 Hashida ..... F04C 2/084 418/197

FOREIGN PATENT DOCUMENTS

DE 4342897 A1 6/1994
DE 102009028004 A1 1/2010

* cited by examiner

METHOD OF MANUFACTURING A SCREW PUMP WITHOUT UNDERCUT AND/OR SCREW PUMP WHICH CAN HAVE LUBRICATION CHANNELS ON AT LEAST ONE OF THE DRIVE SCREW AND RUNNING SCREWS

CROSS REFERENCE TO RELATED APPLICATIONS

This application claims priority to German patent application no. 102015218679.2 filed on Sep. 29, 2015, the contents of which are fully incorporated herein by reference.

FIELD OF THE INVENTION

The present invention concerns a screw pump for transporting a fluid, with a drive spindle and a running spindle, a method for producing a spindle profile for such a screw pump, and a method for producing a lubricant groove in a spindle of such a screw pump.

BACKGROUND OF THE INVENTION

Screw pumps normally provide at least one drive spindle and a running spindle, the threads of which intermesh and roll on each other, whereby fluid can be transported from a first side of the screw pump to a second side of the screw pump.

In order to guarantee such a fluid transport, the flanks of the spindles have special toothing profiles which are produced by means of material removal methods such as for example milling, sanding or lapping. As well as the high material use which is caused by the additional material volume to be removed during the machining process, the material removal process is also very time-intensive since the spindle threads must be passed repeatedly in order to create the corresponding toothing profile.

BRIEF SUMMARY OF THE INVENTION

The object of the present invention is therefore to provide a screw pump which can be produced at less cost and in less time.

A screw pump is described below for transporting a fluid, with a drive spindle having a drive spindle profile and with at least one running spindle having a running spindle profile. The running spindle with its running spindle profile engages at least partly in the drive spindle profile of the drive spindle.

In order to achieve a particularly rapid and economic production of the screw pump and in particular the spindles, it is proposed to form the drive spindle profile and/or the running spindle profile as rolled profiles. The rolling process indeed requires very great experience and correspondingly designed tooling, but no extra material need be provided for the formation of the profile itself since this is pressed at the corresponding points during the rolling process. Since in addition there is no need for multiple passes of the profile, the drive or running spindle can be produced as an endless spindle which can then be shortened to the corresponding lengths. Furthermore, the rolling process has the advantage that no surface roughness occurs because of material compression, so that further treatment such as for example grinding can be largely omitted. Also, the rolling process provides surfaces with constant quality within a very narrow tolerance range. A further advantage of the rolled profile is that spindle profiles with particularly hard flanks can be produced.

Since however the rolling process only allows a restricted range of profiles, rolled profiles have previously not been used for screw pumps. The inventors have however found that the very profiles used in particular in screw pumps are ideal for rolling, in particular because of the absence of undercut. Thus in an advantageous exemplary embodiment, the drive spindle or running spindle profile is formed as an involute profile or epicycloid profile, or in general as a profile without undercut. Such profiles can easily be produced using the rolling method and are ideal for use in screw spindles.

According to a further advantageous exemplary embodiment, the drive spindle and/or the running spindle on its outer edge has a lubricant groove extending substantially radially inward. The lubricant grooves are configured to reduce friction between the spindles and a housing surrounding the spindles. Such lubricant grooves, as known from the prior art, can be milled directly into the outer edge, wherein such a process requires an additional work step and additional use of material.

As a further aspect of the present invention however shows, such a lubricant groove can be produced automatically however during rolling so that no additional work step or additional material is required. Therefore the further aspect of the present invention relates to a method for producing such a lubricant groove with a first groove wall and a second groove wall, and a groove base arranged in-between, wherein the lubricant groove is formed on an outer edge of a spindle and the groove base extends substantially radially inwardly from the outer edge of the spindle. The method preferably provides the steps: creation of a first spindle profile flank by means of rolling, whereby a first groove wall is formed by displacement of material on rolling, and wherein a second groove wall is produced by displacement of material on creation of a second spindle profile flank by means of rolling. The groove base lying in-between results with no further working steps, but may optionally be reworked. Thus in a single working step, it is possible both to form the toothing profile and provide the lubricant groove which is otherwise very difficult to create.

According to a further advantageous exemplary embodiment, the drive spindle profile and the running spindle profile intermesh without play. To achieve such a play-free intermeshing with material removal processes requires very high precision and entails a high error rate. Due to the material displacement on rolling however, highly precise spindle profiles can be produced with constant tolerances, so that a play-free intermeshing of drive and running spindle can be achieved without problems. This in turn can reduce leakage losses inside the screw pump.

According to a further advantageous exemplary embodiment, the drive spindle profile is formed complementary to the running spindle profile. Here it is particularly preferred if the flank curvature of the drive spindle is configured substantially convex, while the flank curvature of the running spindle is configured substantially concave.

A further aspect of the present invention concerns a method for producing a spindle profile of a spindle of a screw pump, wherein the spindle profile is formed by means of a rolling process, in particular a cold rolling process. It is particularly preferred if the spindle profile is a rolled involute profile and/or an epicycloid profile and/or a profile without undercut.

The advantages described above can be achieved both with single-thread and with multiple-thread screw pumps.

Further advantages and advantageous embodiments are defined in the description, the claims or the drawings. In particular, the combinations of features given in the description and in the drawings are purely exemplary, so the features may be present individually or combined in other ways.

The invention will be described in more detail below with reference to exemplary embodiments shown in the drawings. The exemplary embodiments and the combinations shown in the exemplary embodiments are purely illustrative and do not define the scope of protection of the invention. This is defined purely by the attached claims.

DETAILED DESCRIPTION OF THE INVENTION

Figure 1:
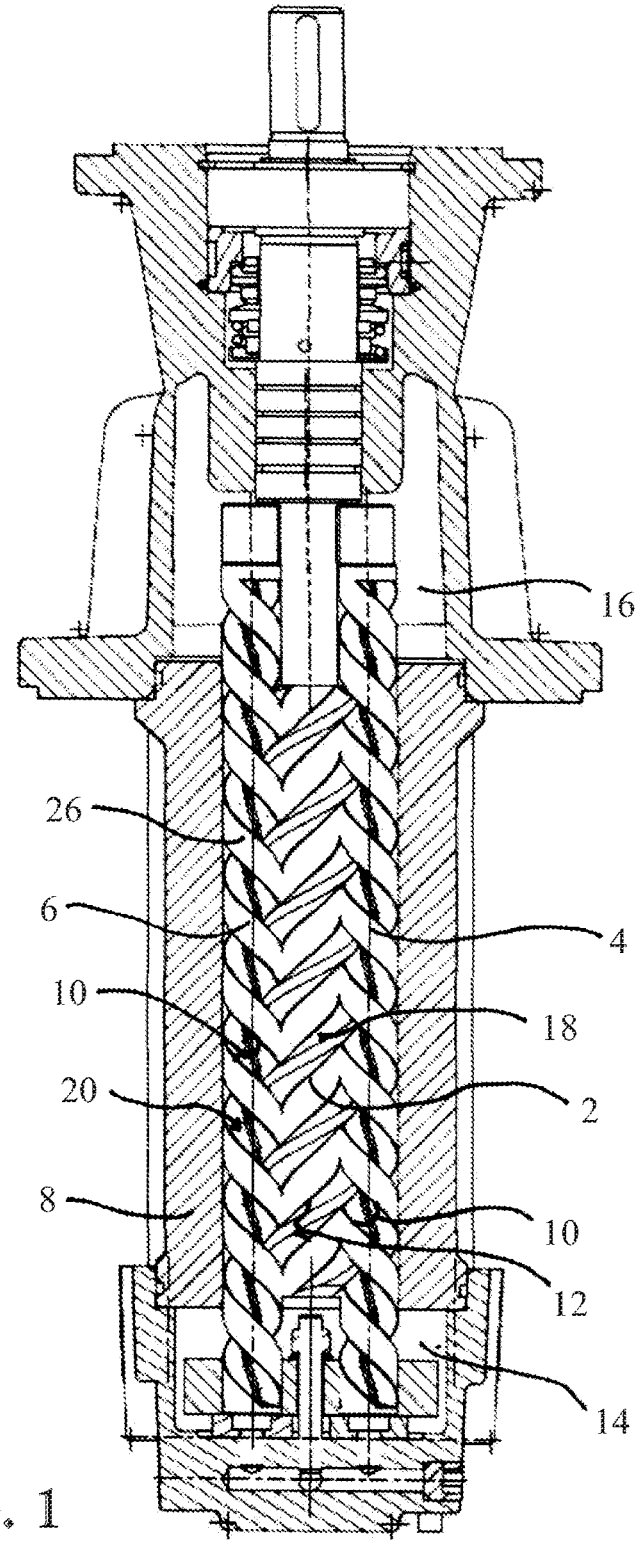
FIG. 1: a diagrammatic section view through a screw pump.

In the description below, the same or equivalent elements carry the same reference numerals.

FIG. 1 shows a longitudinal section through a multiple-thread screw pump 1 with a drive spindle 2 which drives at least two running spindles 4, 6. The drive spindle 2 is rotated in the known manner via a motor. The drive spindle and the running spindles 4, 6 are in turn arranged in a housing 8, wherein the running spindles 4, 6 contact the housing 8 directly.

As further shown in FIG. 1, the drive spindle 2 and the running spindles 4, 6 intermesh so that on rotation of the drive spindle 2, the running spindles 4, 6 also rotate. Furthermore, the drive spindle 2 and the running spindles 4, 6 have drive spindle and running spindle profiles 10, 12 which are configured complementary to each other, so that on rotation of the spindles, a fluid can be "screwed" from a first chamber 14 into a second chamber 16. The flanks 18, 20 of the running spindles and drive spindle 2 are curved complementarily accordingly, wherein usually the flank curvature of a flank 18 of the drive spindle 2 is substantially convex, and the flank curvatures of flanks 20 of running spindles 4, 6 are substantially concave.

Figure 2:
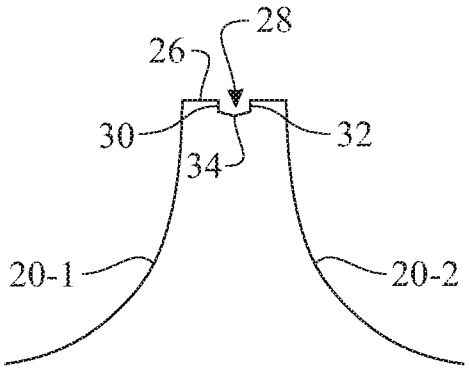
FIG. 2: a diagrammatic radial section view through a spindle of the screw pump shown in FIG. 1.

Such a running spindle profile 10 is shown diagrammatically in FIG. 2. As shown from the figure, the profile 10 is formed as a profile without undercut which follows an epicycloid curve. Alternatively, other profiles without undercut, such as for example an involute profile, may be formed. Such profiles are ideal for screw pumps 1 and can advantageously be rolled.

Figure 3:
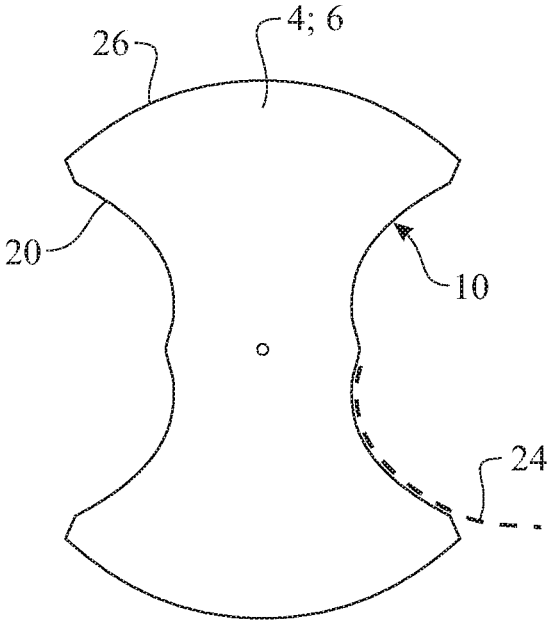
FIG. 3: a diagrammatic depiction of the machining of a spindle.

As FIG. 3 shows, for the formation of a rolled profile, a rolling tool 24 is guided along the spindles 2; 4; 6. Because of the pressure exerted by the tool 24, the material of the spindles 2; 4; 6 is pressed into the corresponding form for the profile 10. The rolling process indeed requires great experience and correspondingly configured tools 24, but no extra material need be provided for the formation of the profile itself, since this is pressed at the corresponding points during the rolling process. Since in addition, multiple passes of the profile 10 are not required, the drive or running spindles 2; 4; 6 can be produced as endless spindles which are then shortened to the corresponding lengths. Furthermore, the rolling process has the advantage that no surface roughness occurs because of material compression, so that further treatment such as for example grinding can be largely omitted. Also, the rolling process gives surfaces with constant quality within a very narrow tolerance range. A further advantage of the rolled profile is that spindle profiles 10 with particularly hard spindle profile flanks 20-1, 20-2 can be provided.

The profile 12 of the drive spindle 2 can be produced similarly.

Figure 4:
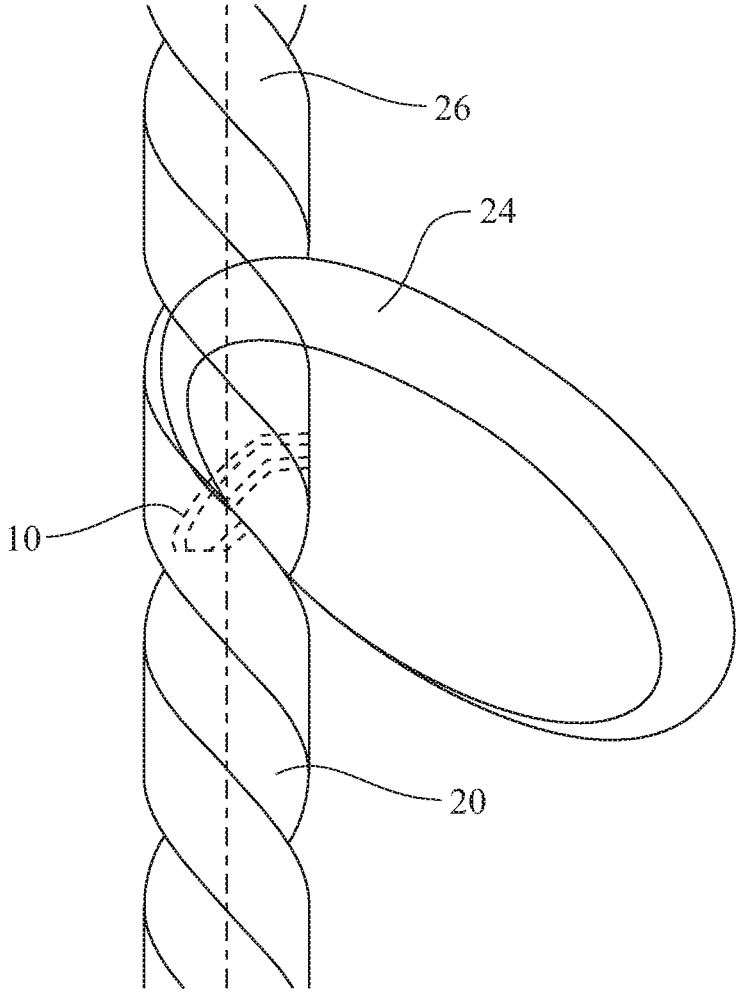
FIG. 4: a diagrammatic section view through a flank of the spindle shown in FIGS. 1 and 2.

As FIG. 1 further shows, the running spindles 4, 6 lie with their outer edges 26 directly on the housing 8. Consequently, friction occurs between the housing 8 and the outer edges 26, which can be reduced if—as shown in FIG. 4—a groove 28 is produced in the outer edge 26. This groove has two groove walls 30, 32 and a groove base 34 lying in-between.

This lubricant groove may advantageously be made directly on rolling of the profile 10, since the material displaced during rolling can be built up as the groove walls 30, 32. Thus there is no need for the difficult milling of the groove 28. The groove base 34 may however still be optionally reworked.

As a whole, with the screw pump with rolled profile, a screw pump can be provided which is simpler and faster to produce. It also constitutes a cost saving since no additional material need be provided for the material removal process. Also, with the rolled profile, tolerances can be achieved which are difficult to achieve with material removal processes. In particular, involute profiles, epicycloid profiles or profiles without undercut are easy to produce with the rolling process and at the same time offer good pumping properties for a fluid transport.

LIST OF REFERENCE NUMERALS

1 Lubricant pump
2 Drive spindle
4, 6 Running spindle
8 Housing
10 Running spindle profile
12 Drive spindle profile
14 First receiver region for a fluid
16 Second receiver region for a fluid
18 Profile flank of drive spindle
20 Profile flank of running spindle
22 Epicycloid curve
24 Rolling tool
26 Outer edge of running spindle
28 Lubricant groove
30, 32 Groove wall
34 Groove base

The invention claimed is:

1. A method for manufacturing a screw pump for transporting a fluid, the method comprising the steps of:

providing a drive spindle having a drive spindle profile, providing a running spindle, rolling a running spindle profile into the running spindle such that the running spindle profile is formed without undercut, simultaneously with the rolling of the running spindle profile into the running spindle also forming a lubricant groove in the running spindle, and wherein the running spindle engages with its running spindle profile at least partially in the drive spindle profile of the drive spindle.

2. The method according to claim 1, wherein the step of providing the drive spindle further comprises rolling a drive spindle profile into the drive spindle such that the drive spindle profile is formed without undercut.

3. The method according to claim 1, wherein the step of forming the lubricant groove comprises using material displaced during the rolling of the running spindle profile to build up first and second lubricant groove walls.

4. The method according to claim 1, wherein the method of manufacturing the screw pump further comprises the screw pump having a single thread.

5. The method according to claim 1, wherein the method of manufacturing the screw pump further comprises the screw pump having multiple threads.

6. The method according to claim 1, wherein the method of manufacturing the screw pump further comprises the drive spindle profile and the running spindle profile intermeshing while maintaining contact during operation.

7. The method according to claim 1, wherein the method of manufacturing the screw pump further comprises the drive spindle profile formed complementary to the running spindle profile.

8. The method according to claim 1, wherein the step of rolling the running spindle profile uses a cold rolling process.

9. The method according to claim 8, wherein the running spindle profile is a rolled involute profile.

10. The method of claim 1, wherein the step of forming the lubricant groove further comprises:

a. creating a first running spindle profile flank by rolling;
b. forming a first groove wall by displacement of material on rolling of the first running spindle profile flank;
c. creating a second running spindle profile flank by rolling; and
d. forming a second groove wall by displacement of material upon rolling of the second running spindle profile flank.

11. The method according to claim 10, wherein the step of providing the running drive spindle further comprises rolling the drive spindle profile into the drive spindle such that the drive spindle profile is formed without undercut.

* * * * *